US008603017B2

(12) United States Patent
Trandafir et al.

(10) Patent No.: US 8,603,017 B2
(45) Date of Patent: Dec. 10, 2013

(54) VIBRATIONAL THERAPY ASSEMBLY FOR TREATING AND PREVENTING THE ONSET OF DEEP VENOUS THROMBOSIS

(75) Inventors: Titi Trandafir, S. Plainfield, NJ (US); Roger J. Talish, Hillsborough, NJ (US); Kenneth McLeod, Vestal, NY (US)

(73) Assignee: American Medical Innovations, L.L.C., Fort Myers Beach, FL (US)

( * ) Notice: Subject to any disclaimer, the term of this patent is extended or adjusted under 35 U.S.C. 154(b) by 1843 days.

(21) Appl. No.: 11/488,227

(22) Filed: Jul. 18, 2006

(65) Prior Publication Data

US 2007/0038165 A1 Feb. 15, 2007

Related U.S. Application Data

(63) Continuation-in-part of application No. 11/369,467, filed on Mar. 7, 2006, now abandoned, which is a continuation-in-part of application No. 11/388,286, filed on Mar. 24, 2006, now Pat. No. 8,491,509.

(60) Provisional application No. 60/700,092, filed on Jul. 18, 2005, provisional application No. 60/702,735, filed on Jul. 27, 2005, provisional application No. 60/702,815, filed on Jul. 27, 2005, provisional application No. 60/665,013, filed on Mar. 24, 2005, provisional application No. 60/659,216, filed on Mar. 7, 2005.

(51) Int. Cl.
*A61H 1/00* (2006.01)

(52) U.S. Cl.
USPC ..... 601/49

(58) Field of Classification Search
USPC ..... 601/23, 24, 26, 27, 29–33, 84, 86, 87, 601/89–93, 97, 98, 100, 101, 104, 143–147
See application file for complete search history.

(56) References Cited

U.S. PATENT DOCUMENTS

| | | | | |
|---|---|---|---|---|
| 1,125,931 | A | | 1/1915 | Arnest |
| 1,945,675 | A | | 2/1934 | Binney |
| 2,193,978 | A | | 3/1940 | Miller |
| 2,345,439 | A | | 3/1944 | Tompkins |
| 2,779,328 | A | | 1/1957 | Grossi |
| 2,845,063 | A | | 7/1958 | Charles |
| 2,902,993 | A | * | 9/1959 | Wagner ..... 601/58 |
| 2,916,745 | A | | 12/1959 | Lesk et al. |
| 3,134,451 | A | | 5/1964 | Hanssen |
| 3,193,034 | A | | 7/1965 | Hutchinson et al. |
| 3,304,036 | A | | 2/1967 | Davis |

(Continued)

FOREIGN PATENT DOCUMENTS

| | | |
|---|---|---|
| AU | 43933/93 | 12/1993 |
| CA | 2136012 | 12/1993 |

(Continued)

OTHER PUBLICATIONS

PCT International Search Report dated Oct. 30, 2006 for PCT/US2006/027723 filed Jul. 18, 2006.

(Continued)

*Primary Examiner* — Kristen Matter
(74) *Attorney, Agent, or Firm* — Malloy & Malloy, P.L.

(57) ABSTRACT

A vibrational therapy assembly treating and preventing Deep Venous Thrombosis, and other conditions, using vibrational energy.

12 Claims, 5 Drawing Sheets

(56) References Cited

U.S. PATENT DOCUMENTS 3,304,449 A 2/1967 Pohlman et al.
3,499,437 A 3/1970 Balamuth
3,581,739 A 6/1971 Brandt et al.
3,593,239 A 7/1971 Hofman
3,760,799 A 9/1973 Crowson
3,762,402 A 10/1973 Abramovitz
3,765,407 A 10/1973 Prince
3,767,195 A 10/1973 Dimick
3,841,320 A 10/1974 Brown
3,890,953 A 6/1975 Kraus et al.
3,911,907 A 10/1975 Smith, Jr.
3,961,380 A 6/1976 Garr
4,013,069 A 3/1977 Hasty
4,105,017 A 8/1978 Ryaby et al.
4,232,661 A 11/1980 Christensen
4,266,532 A 5/1981 Ryaby et al.
4,266,533 A 5/1981 Ryaby et al.
4,315,503 A 2/1982 Ryaby et al.
4,326,506 A 4/1982 Kawabata
4,358,105 A 11/1982 Sweeney, Jr.
4,369,537 A 1/1983 Midgley
4,381,040 A 4/1983 Brouwer
D269,305 S 6/1983 Nakao et al.
4,446,586 A 5/1984 Reed et al.
4,452,326 A 6/1984 Hanssen et al.
4,530,360 A 7/1985 Duarte
4,570,927 A 2/1986 Petrofsky et al.
4,669,483 A 6/1987 Hepp et al.
4,687,195 A 8/1987 Potts
4,697,581 A 10/1987 Endo et al.
4,710,655 A 12/1987 Masaki
4,750,574 A 6/1988 Williams
4,782,822 A 11/1988 Ricken
4,787,888 A 11/1988 Fox
4,788,968 A 12/1988 Rudashevsky et al.
D299,787 S 2/1989 Bates
4,836,316 A 6/1989 Carnevale et al.
4,858,599 A 8/1989 Halpern
4,890,953 A 1/1990 Malatesta
4,905,671 A 3/1990 Senge et al.
4,913,248 A 4/1990 Zakai
4,917,376 A 4/1990 Lo
4,927,138 A * 5/1990 Ferrari ..... 482/91
4,928,959 A 5/1990 Bassett et al.
4,986,534 A 1/1991 Meier et al.
5,000,442 A 3/1991 Dalebout et al.
5,003,965 A 4/1991 Talish et al.
5,046,484 A 9/1991 Bassett et al.
5,103,806 A 4/1992 McLeod et al.
5,107,540 A 4/1992 Mooney et al.
5,108,452 A 4/1992 Fallin et al.
5,113,850 A 5/1992 Larremore et al.
5,133,420 A 7/1992 Smith
5,145,027 A 9/1992 Petzl et al.
5,186,162 A 2/1993 Talish et al.
5,188,095 A 2/1993 Healy
5,191,880 A 3/1993 McLeod et al.
5,211,160 A 5/1993 Talish et al.
5,255,957 A 10/1993 Opsvik et al.
5,273,028 A 12/1993 McLeod et al.
5,273,502 A 12/1993 Kelsey et al.
5,295,931 A 3/1994 Dreibelbis et al.
5,318,561 A 6/1994 McLeod et al.
RE34,663 E 7/1994 Seale
5,335,188 A 8/1994 Brisson
5,336,144 A 8/1994 Rodden
5,337,757 A 8/1994 Jain et al.
5,339,804 A 8/1994 Kemp
5,351,389 A 10/1994 Erickson et al.
5,368,044 A 11/1994 Cain et al.
5,376,065 A 12/1994 McLeod et al.
5,380,269 A 1/1995 Urso
5,409,446 A 4/1995 Rattner
RE34,959 E 5/1995 Potts
5,429,585 A 7/1995 Liang
5,431,612 A 7/1995 Holden
5,437,668 A 8/1995 Aronson et al.
5,466,215 A 11/1995 Lair et al.
5,468,220 A 11/1995 Sucher
5,478,306 A 12/1995 Stoner
5,484,388 A 1/1996 Bassett et al.
5,492,525 A 2/1996 Gibney
5,496,256 A 3/1996 Bock et al.
5,501,657 A 3/1996 Feero
5,520,612 A 5/1996 Winder et al.
5,520,614 A 5/1996 McNamara et al.
5,538,489 A 7/1996 Magid
5,556,372 A 9/1996 Talish et al.
5,578,060 A 11/1996 Pohl et al.
5,602,432 A 2/1997 Mizutani
5,626,554 A 5/1997 Ryaby et al.
5,702,353 A 12/1997 Guzzini et al.
5,708,236 A 1/1998 Shaanan et al.
5,716,331 A 2/1998 Chang
5,721,400 A 2/1998 Haraldsson et al.
5,730,705 A 3/1998 Talish et al.
5,741,317 A 4/1998 Ostrow
5,755,746 A 5/1998 Lifshey et al.
5,762,616 A 6/1998 Talish
5,779,600 A 7/1998 Pape
5,797,860 A 8/1998 Moriyasu
5,868,649 A 2/1999 Erickson et al.
5,871,446 A 2/1999 Wilk
5,886,302 A 3/1999 Germanton et al.
5,904,659 A 5/1999 Duarte et al.
5,910,123 A 6/1999 Wang
5,913,838 A 6/1999 Reilly
5,957,814 A 9/1999 Eschenbach
5,971,984 A 10/1999 Taylor et al.
5,987,982 A 11/1999 Wenman et al.
5,997,490 A 12/1999 McLeod et al.
6,019,710 A 2/2000 Dalebout et al.
6,022,349 A 2/2000 McLeod et al.
D421,828 S 3/2000 Malka
6,050,364 A 4/2000 Popall et al.
6,061,597 A 5/2000 Rieman et al.
6,063,046 A 5/2000 Allum
6,068,596 A 5/2000 Weth et al.
6,080,088 A 6/2000 Petersen et al.
6,086,078 A 7/2000 Ferez
6,093,135 A 7/2000 Huang
6,106,491 A 8/2000 Gianutsos
6,116,691 A 9/2000 Reece
6,119,291 A * 9/2000 Osborne et al. ..... 5/600
6,179,797 B1 1/2001 Brotz
6,234,975 B1 5/2001 McLeod et al.
6,258,020 B1 7/2001 Lopez
6,346,088 B1 2/2002 Stone et al.
6,421,935 B1 7/2002 Bartlett
6,440,046 B1 8/2002 Tholkes
D467,407 S 12/2002 Berg et al.
D471,346 S 3/2003 Bray, Jr. et al.
6,558,304 B1 5/2003 Bardon et al.
6,561,991 B2 5/2003 McLeod et al.
6,607,497 B2 8/2003 McLeod et al.
6,610,021 B1 8/2003 Bock
6,620,117 B1 9/2003 Johnson et al.
6,632,158 B1 10/2003 Nashner
6,656,137 B1 12/2003 Tyldsley et al.
6,843,776 B2 1/2005 Trandafir et al.
6,884,227 B2 4/2005 Krompasick
6,902,320 B2 6/2005 McKenna
2001/0000782 A1 5/2001 Schiessl
2002/0077570 A1 6/2002 McLeod et al.
2002/0183662 A1* 12/2002 Lu et al. ..... 601/28
2003/0083599 A1 5/2003 Kitov
2003/0090374 A1 5/2003 Quigley
2004/0059331 A1 3/2004 Mullaney
2004/0067833 A1* 4/2004 Talish et al. ..... 482/148
2004/0068211 A1 4/2004 Leivseth et al.
2004/0092848 A1 5/2004 Trandafir et al.
2004/0092849 A1* 5/2004 Talish ..... 601/90
2004/0260211 A1 12/2004 Maalouf
2005/0026750 A1 2/2005 Oglesby et al.

(56) References Cited

U.S. PATENT DOCUMENTS

| | | | |
|---|---|---|---|
| 2005/0131319 | A1 | 6/2005 | der Meer |
| 2005/0148911 | A1 | 7/2005 | Talish et al. |
| 2005/0154334 | A1 | 7/2005 | Trandafir et al. |
| 2006/0047230 | A1 | 3/2006 | Talish |

FOREIGN PATENT DOCUMENTS

| | | | |
|---|---|---|---|
| CH | 323767 | | 8/1957 |
| DE | 1566521 | | 3/1971 |
| DE | 3227519 | | 2/1983 |
| DE | 9410902 | | 11/1995 |
| DE | 196 39 477 | A1 | 4/1998 |
| DE | 10201255 | | 7/2003 |
| EP | 0029298 | | 5/1981 |
| EP | 0695559 | | 2/1996 |
| EP | 1026484 | | 8/2000 |
| EP | 0642331 | | 1/2001 |
| EP | 1 400 264 | A1 | 3/2004 |
| FR | 2 562 446 | | 10/1985 |
| JP | 60150749 | | 8/1985 |
| JP | 62-72359 | | 4/1987 |
| JP | 2-60608 | | 3/1990 |
| JP | U 2-32830 | | 3/1990 |
| JP | U 4-3736 | | 1/1992 |
| JP | 5317376 | | 12/1993 |
| JP | 7507224 | | 8/1995 |
| JP | 3036291 | | 1/1997 |
| JP | 3038101 | | 6/1997 |
| JP | 11319144 | | 11/1999 |
| JP | 2000-60978 | | 2/2000 |
| JP | 3069745 | | 4/2000 |
| JP | 2001 000496 | | 1/2001 |
| JP | 2001-017493 | | 1/2001 |
| JP | 2001 070383 | | 3/2001 |
| JP | 2001-513352 | | 9/2001 |
| JP | 2001-517134 | | 10/2001 |
| JP | 2001 346846 | | 12/2001 |
| JP | 2002-153349 | | 5/2002 |
| JP | 2002-306559 | | 10/2002 |
| JP | 2002-325808 | | 11/2002 |
| JP | 2003-102801 | | 4/2003 |
| JP | 3547742 | | 4/2004 |
| JP | 2004-321665 | | 11/2004 |
| JP | 2004-337275 | | 12/2004 |
| JP | 2005-512721 | | 5/2005 |
| KR | 0225300 | | 7/1999 |
| MX | 183314 | | 11/1996 |
| SU | 584842 | | 12/1977 |
| WO | WO 93/24092 | | 12/1993 |
| WO | WO 95/21580 | | 8/1995 |
| WO | WO 96/03104 | | 2/1996 |
| WO | WO 02/053084 | | 7/2002 |
| WO | WO 03/030805 | | 4/2003 |
| WO | WO 03/055389 | | 7/2003 |
| WO | WO 2004/043324 | | 5/2004 |
| WO | WO 2004/096108 | A2 | 11/2004 |
| WO | WO 2004/103244 | A1 | 12/2004 |
| WO | WO 2005/000188 | A1 | 1/2005 |

OTHER PUBLICATIONS

Edward, V., PCT International Search Report (ISR) for PCT/US2006/008132. Jul. 2, 2006, European Patent Office.

Knoflacher, N., PCT International Search Report (ISR) for PCT/US2007/015732. Jan. 24, 2008, European Patent Office.

Knoflacher, N., PCT International Search Report (ISR) and Written Opinion for PCT/US2007/015694. Dec. 12, 2007, European Patent Office.

Artikis, T., PCT International Search Report (ISR) for PCT/US2006/010753. Jul. 20, 2006, European Patent Office.

Fischer, E., PCT International Search Report (ISR) for PCT/US2006/007983. Jul. 13, 2006, European Patent Office.

Yu, J., International Preliminary Report on Patentability (IPRP) for PCT/US06/07983. Apr. 20, 2007, Alexandria, VA.

Fischer, E., PCT International Search Report (ISR) for PCT/US2006/027355. Oct. 26, 2006, European Patent Office.

Fischer, E., PCT International Search Report (ISR) for PCT/US2006/027832. Oct. 26, 2006, European Patent Office.

Pope, M.H. et al., "Mounting of the Transducers in Measurement of Segmental Motion of the Spine," J. Biomechanics, 1986, pp. 675-677, vol. 19, No. 8.

Holmlund et al., "Mechanical impedance of the human body in vertical direction," Applied Ergonomics, Elsevier Science Ltd. (2000).

Wei et al., "The prediction of seat transmissibility from measures of seat impedance," Journal of Sound and Vibration, 214(1), pp. 121-137 (1998).

Jordan, J., "Good Vibrations and Strong Bones," Am. J. Physiol. Reful. Integr. Comp. Physiol., 288 (3): R555-556 (2005).

Stewart, J.M. et al., "Plantar vibration improved leg fluid . . . ," The American Journal of Phgy—Reg, Integ and Comp Phgy, Oct. 7, 2004, 288:R623-R629, New York, NY.

Walsh, W.R. et al., "Influence of Dynamic Motion Therapy on bone ingrowth into a bone graft substitute", Surg. & Ortho. Res. Labs., Univ. of New S. Wales, w.walsh@unsw.edu.au.

Bassett, C. Andrew L. and Robert O. Becker, "Generation of Electric Potentials by Bone in Response to Mechanical Stress," Science Magazine, 137, pp. 1063-1064 (1962).

El Haj, A.J., Skerry, T.M., Caterson, B., Lanyon, L.E., "Protoglycans in Bone Tissue: Identification, and Possible Function in Strain-related Bone Remodeling," presented at the 34th Annual Meeting, ORS (Feb. 1988).

Skerry, T.M., Pead, M.J., Suswillo, R., Vedi, S., Lanyon, L.E., "Strain-related Remodeling in Bone Tissue: Early Stages of the Cellular Response to Bone Loading In Vivo," presented at the 34th Annual Meeting, ORS (Feb. 1988).

Fritton, S.P., Hart, R.T., "Simulation of In Vivo Trabecular Bone Adaptation," presented at 41st Annual meeting of the Orthopaedic Research Society, Orlando, Florida Feb. 13-16, 1995.

McLeod, K.J., "Effects of Low Level Vibration on Muscle Activity and Blood Flow," presented at 3rd Meeting of the Micromechanical Tissue Repair Society (MTR), San Diego, California (2002).

Goodship, A., "The Implications of Micromotion on Bone Repair and Tissue Differentiation," presented at 3rd Meeting of the Micromechanical Tissue Repair Society (MTR), San Diego California (2002).

Madhavan, G., Villanueva, Jr. A., McLeod, K.J., "Frequency Dependent Response of the Cardio-Vascular System to Foot Based Vibration While in the Seated Position," presented at the Biomedical Engineering Society Annual Meeting (2002).

Villanueva, Jr. A., Madhavan, G., McLeod, K.J., "Changes in the Non-Linear Dynamics of Heart Rate Variability Due to Foot Based Vibration While in the Seated Position," presented at the Biomedical Engineering Society Annual Meeting (2002).

McLeod, K.J., Ryaby, J.P., McCabe, J.M., "The Role of Postural Sway in the Maintenance of Bone Mass," poster presentation, ASBMR, 24th Annual Meeting, San Antonio, Texas (Sep. 2002).

Madhavan, G., McLeod, K.J., "Effect of Plantar Stimulation on Heart Rate Variability Under Orthostatically Stressed Conditions," Biomedical Engineering Society Annual Meeting (2003).

McLeod, K.J., Ryaby, J.P., "Bone Mass and Skeletal Muscle Pump Activity in Elderly Persons," poster presentation, 1st Joint Meeting of the Int'l Bone and Mineral Society (IBMS) and the Japanese Society of Bone and Mineral Research (JSBMR), Osaka, Japan (Jun. 2003).

McLeod, K.J., Lee, D., Davenport, D., "Bone Mineral Density and Orthostatic Intolerance in the Perimenopausal Population," poster presentation, 1st Joint Meeting of the Int'l Bone and Mineral Society (IBMS) and the Japanese Society of Bone and Mineral Research (JSBMR), Osaka, Japan (Jun. 2003).

McLeod, K.J., McCabe, J., and Ryaby, J.P., "The Role of Postural Sway in the Maintenance of Bone Mass," submitted to J. Gerontology (Jan. 2004).

McLeod, K.J., Spathis, R., "Vascular Pressure in the Lower Limbs and Bone Mineral Density," submitted to the Am. Society for Bone and Mineral Research (2004).

McLeod, K.J., Stewart, J.M, "Lymphatic Flow and Bone Mineral Density," presented at ASBMR (2004).

(56) References Cited

OTHER PUBLICATIONS

Midura, R.J., Dillman, C.J., Grabiner, M.D., "Low amplitude, high frequency strains imposed by electrically stimulated skeletal muscle retards the development of osteopenia in the hindlimb of suspended rats," Med. Eng. & Phys., 27 (2005) 285-293.

Madhavan G, Stewart JM, McLeod KJ, "Effect of Plantar Micromechanical Stimulation on Cardiovascular[. . . ]," Am. J. Phys. Med. Rehabil., 2005, vol. 84, No. 5, 338-345.

Frankel, V.H and McLeod, K.J., "Calf Muscle Stimulation as an Adjunct to Orthopaedic Surgery," manuscript submitted for publication (submitted Apr. 2005).

* cited by examiner

VIBRATIONAL THERAPY ASSEMBLY FOR TREATING AND PREVENTING THE ONSET OF DEEP VENOUS THROMBOSIS

PRIORITY

The present application claims priority to a U.S. Provisional Application filed on Jul. 18, 2005 and assigned U.S. Provisional Application Ser. No. 60/700,092, now abandoned; the entire contents of the provisional application are incorporated herein by reference.

The entire contents of U.S. Provisional Application filed on Jul. 11, 2006 titled "System and Method for a Low Profile Vibrating Plate", now abandoned, are incorporated herein by reference.

The present application is also a Continuation-In-Part patent application of a U.S. patent application filed on Mar. 7, 2006 titled "System and Method for a Low Profile Vibrating Plate" and assigned U.S. patent application Ser. No. 11/369,467, now abandoned; the entire contents of which are incorporated herein by reference. U.S. patent application Ser. No. 11/369,467 claims priority from U.S. Provisional Application filed on Mar. 7, 2005, titled "System and Method for a Low Profile Vibrating Plate" and assigned U.S. Provisional Application Ser. No. 60/659,216, now abandoned; the entire contents of which are incorporated herein by reference.

The entire contents of currently pending U.S. patent application filed on Jul. 17, 2006 titled "Dynamic Motion Therapy Apparatus Having a Treatment Feedback Indicator", are incorporated herein by reference. U.S. patent application filed on Jul. 17, 2006, titled "Dynamic Motion Therapy Apparatus Having a Treatment Feedback Indicator" claims priority from U.S. patent application filed on Mar. 6, 2006 titled "Supplemental Support Structures Adapted to Receive a Non-invasive Dynamic Motion Therapy Device" and assigned U.S. patent application Ser. No. 11/369,611, now abandoned; the contents of which are hereby incorporated by reference. U.S. patent application Ser. No. 11/369,611 claims priority from a U.S. Provisional Application filed on Mar. 7, 2005 and assigned U.S. Provisional Application No. 60/659,159, now abandoned; the contents of which are hereby incorporated by reference.

The U.S. patent application filed on Jul. 17, 2006 is also a Continuation-In-Part patent application of a U.S. patent application filed on Mar. 24, 2006 titled "Apparatus and Method for Monitoring and Controlling the Transmissibility of Mechanical Vibration Energy During Dynamic Motion Therapy" and assigned U.S. patent application Ser. No. 11/388,286, now abandoned; the contents of which are hereby incorporated by reference. U.S. patent application Ser. No. 11/388,286 claims priority from a U.S. Provisional Application filed on Mar. 24, 2005 and assigned U.S. Provisional Application No. 60/665,013, now abandoned; the contents of which are hereby incorporated by reference.

The U.S. patent application filed on Jul. 17, 2006 further claims the benefit of and priority to U.S. Provisional Application filed on Jul. 27, 2005 titled "Method and Apparatus for Monitoring Patient Compliance During Dynamic Motion Therapy" and assigned U.S. Provisional Application Ser. No. 60/702,815, now abandoned; the contents of which are hereby incorporated by reference. Additionally, the U.S. patent application filed on Jul. 17, 2006 claims the benefit of and priority to U.S. Provisional Application filed on Jul. 27, 2005 titled "Dynamic Motion Therapy Apparatus Having a Treatment Feedback Indicator" and assigned U.S. Provisional Application Ser. No. 60/702,735, now abandoned; the contents of which are hereby incorporated by reference.

CROSS-REFERENCE TO RELATED PATENTS

The present application is also related to U.S. Pat. Nos. 6,234,975; 6,561,991; and 6,607,497, the entire contents of which are incorporated herein by reference.

BACKGROUND

1. Technical Field

The present disclosure relates generally to a non-invasive medical treatment apparatus. More particularly, the present disclosure relates to a vibrational therapy apparatus for delivering vibrational therapy and treating and preventing the onset of deep venous thrombosis (DVT).

2. Description of the Prior Art

Deep venous thrombosis (DVT) is the occlusion of a deep vein by a blood clot, i.e., thrombus. DVT generally affects the leg veins, such as, for example, the femoral vein or the popliteal vein, and occurs when the blood clot either partially blocks or completely blocks the flow of blood in the vein. A major risk associated with DVT is the development of pulmonary embolism, which occurs when a blood clot breaks loose from the walls of a vein and travels to the lungs, blocking the pulmonary artery or one of its branches.

Although there are several medical factors, such as injury, immobility and clotting disorders, which cause DVT other non-medical factors are also often culprits. For example, prolonged periods of sitting or lying, such as, for example, during an airline flight and a prolonged hospital stay which includes a prolonged period of immobility.

Various treatments have been developed to alleviate the effects of DVT. For example, intermittent pneumatic compression machines are used to improve blood circulation and prevent the formation of thrombi in the limbs of the patient. These devices typically include a pair of compression garments or sleeves which wrap around the patient's limbs, generally the legs. Each sleeve has a plurality of separate inflatable chambers which are connected via conduits to a source of compressed fluid, typically air. The chambers are sequentially inflated to provide a compressive pulse to the limb, thereby increasing blood circulation and minimizing the formation of thrombi. The compressive pulses begin around the portion of the limb farthest from the heart and progress sequentially towards the heart. For example, for a three-chambered leg sleeve, the ankle chamber is inflated first followed by the calf chamber, and then the thigh chamber. Typical compression devices are described in U.S. Pat. Nos. 4,013,069 and 6,610,021. Other methods of treatment for treating DVT include surgical procedures as well as medications, such as, anticoagulants.

However, because a patient may be susceptible to DVT and its effects with little or no warning, the best method against DVT and its effects is preventing the onset of DVT. For example, early and regular ambulation, i.e. walking, is a treatment that is recognized and recommended. Walking enhances blood flow by activating the body's muscle pumps, increasing venous velocity and preventing stasis. Nonetheless, walking is not a viable option for many people, such as elderly and/or infirm individuals. Moreover, walking is not always possible or safe, such as in an aircraft experiencing turbulence. Thus there is a need for a blood flow enhancement apparatus and method for enhancing blood flow to prevent the onset of DVT.

SUMMARY

It is an aspect of the present disclosure to provide a vibrational therapy apparatus that delivers vibrational energy and may be used for treating and preventing the onset of DVT. It is a further object of the present disclosure to provide a vibrational therapy apparatus having a low profile vibrating plate system similar to the low profile vibrating plate system described in U.S. Utility patent application Ser. No. 11/369,467 filed on Mar. 7, 2006, the entire contents of which are incorporated herein by reference.

In accordance with the present disclosure, a vibrational therapy apparatus is provided capable of delivering vibrational energy for treating and preventing the onset of DVT. Other uses are also envisioned, such as treating postural instability. The vibrational therapy apparatus includes at least one platform member including at least one vibrating plate assembly for providing vibrational energy and at least one positioner. The at least one positioner is operatively associated with the at least one platform member for guiding patient tissue adjacent the at least one vibrating plate assembly.

Vibrational plate assembly can provide vibrational energy in at least two configurations of the at least one positioner. In a first configuration, the at least one positioner is substantially perpendicular to the at least one platform member. In a second configuration, the at least one positioner is in juxtaposed relation to the at least one platform member. Positioner is movable between the first configuration and the second configuration. In a first configuration, patient tissue contacts the at least one vibrating plate assembly, and in a second configuration, patient tissue does not contact the at least one vibrating plate assembly.

Vibrational therapy apparatus further includes at least one pad, positioned on the at least one platform member. The at least one pad is configured to contact patient tissue. Pad may be formed of memory foam material and may contact at least a portion of the at least one positioner. Pad may be removable from the apparatus and may be disposable.

Vibrational therapy apparatus further includes a control panel for controlling the operation of the at least one vibrating plate assembly.

In yet another embodiment of the present disclosure, a vibrational therapy assembly is provided which includes a first vibrational therapy apparatus having a first platform member including at least one vibrating plate assembly for providing vibrational energy and a first positioner operatively associated with the first platform member for guiding patient tissue adjacent the first platform member and a second vibrational therapy apparatus having a second platform member including at least one vibrating plate assembly for providing vibrational energy and a second positioner operatively associated with the second platform member for guiding patient tissue adjacent the first platform member and a means for removably connecting the first and second vibrational therapy apparatus. The means for removably connecting engages and disengages the first vibrational therapy apparatus from the second vibrational therapy apparatus.

The first vibrational therapy apparatus and the second vibrational therapy apparatus of the vibrational therapy assembly provide vibrational energy in at least two configurations of the first positioner and the second positioner. In a first configuration, the first and second platform members are parallel with respect to each other and the first and second positioners are substantially perpendicular to the first and second platform member. In a second configuration, the first and second platform members are parallel and with respect to each other and the first positioner and the second positioner are respectively in juxtaposed relation to the first platform member and the second platform member.

BRIEF DESCRIPTION OF THE DRAWINGS

The foregoing features of the present disclosure will become more readily apparent and will be better understood by referring to the following detailed description of preferred embodiments, which are described hereinbelow with reference to the drawings wherein.

DETAILED DESCRIPTION

Figure 1:
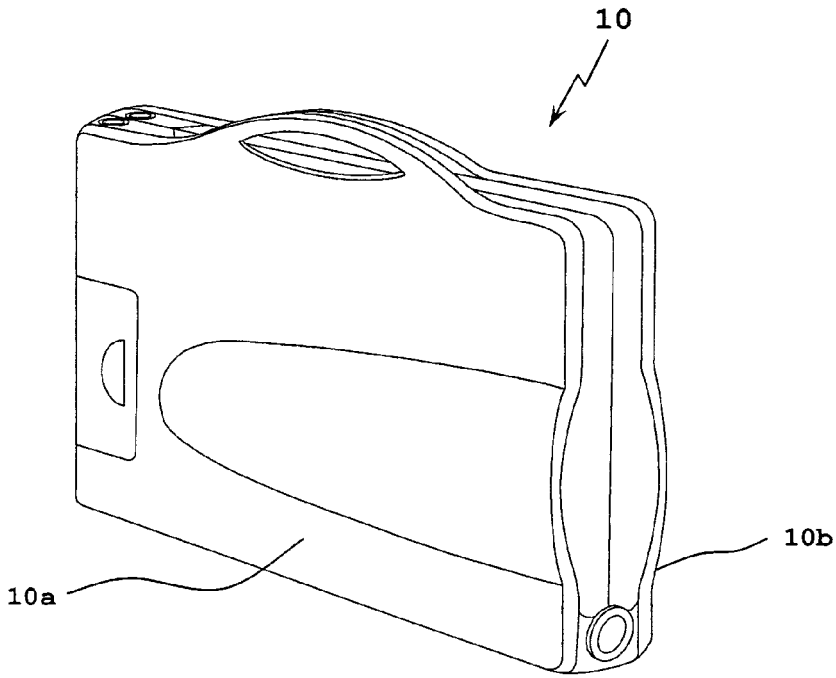
FIG. 1 is a perspective view of a vibrational therapy assembly including two vibrational therapy apparatuses in a portable configuration in accordance with the present disclosure.

It is known to use vibrational treatment to treat conditions, such as postural instability, osteoporosis, etc., as described in U.S. Pat. Nos. 6,234,975; 6,561,991; and 6,607,497, the entire contents of which are incorporated herein by reference. The present disclosure provides for a vibrational therapy assembly and apparatus for providing vibrational treatment for treating and preventing the onset of deep venous thrombosis (DVT).

Preferred embodiments of the presently disclosed vibrational therapy assembly and apparatus will now be described in detail with reference to the drawing figures in which like reference numerals identify identical or corresponding elements.

With initial reference to FIG. 1, a vibrational therapy assembly in accordance with the present disclosure is illustrated in a portable configuration, and is designated generally as vibrational therapy assembly 10. Vibrational therapy assembly 10 includes two vibrational therapy apparatuses 10*a*, 10*b* as described in the present disclosure. Vibrational therapy apparatuses 10*a*, 10*b* configured as a vibrational therapy assembly 10 is adapted to enhance blood flow and to treat and prevent the onset of DVT. However, one skilled in the art of vibrational treatment can envision conditions/ailments that can be treated or prevented using the assembly 10 and apparatus 10*a*, 10*b*.

Figure 1A:
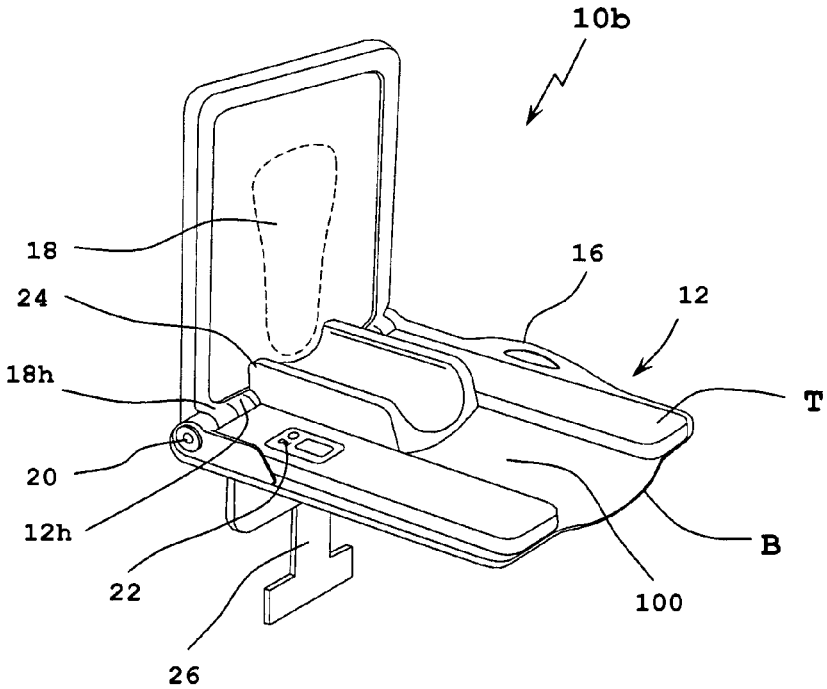
FIG. 1A is a perspective view of a vibrational therapy apparatus of FIG. 1 in an open configuration illustrating the internal components thereof in accordance with the present disclosure.

FIG. 1A is a perspective view of vibrational therapy apparatus 10*b*, in an open configuration, illustrating the internal components thereof in accordance with the present disclosure. Apparatus 10*b* comprises platform member 12 and positioner 18. Platform member 12 includes a bottom portion B and top portion T. Platform member 12 includes at least one vibrating plate assembly 100, adapted to provide vibrational energy to patient tissue. The vibrational energy treats or prevents the onset of DVT.

Positioner 18 is operatively associated with platform member 12. In FIG. 1A, positioner 18 is hingedly attached to platform member 12. Pivot Pin 20 secures hinge portion 12*h* of platform member 12 to hinge portion 18*h* of positioner 18. Various other attachment means may be used such that positioner is pivotally attached to at least a portion of platform member 12 (i.e. a plurality of hinge sections, one or more living hinges, or more ball-joints, etc.).

Positioner 18 may guide positioning of patient tissue adjacent to at least a portion of platform member 12, such as, for example, guiding or positioning of a patient tissue adjacent the vibrating plate assembly 100. Patient tissue, such as, for example, a leg and/or foot, is oriented such that vibrational energy generated by the vibrating plate assembly 100 is transferred to patient tissue. Patient tissue may receive vibration energy by direct contact with vibrating plate assembly 100. Patient tissue may also receive vibrational energy indirectly from vibration plate assembly 100, wherein vibrational energy is transferred through another portion of assembly 10*b*. For example, patient tissue may contact the positioner 18 or the pad 24 and vibrational energy is transferred from the vibrating plate assembly 100 through the positioner or the pad and to patient tissue.

Positioner 18 may lock in one or more angular positions relative to platform member 12. Hinge section may include a locking mechanism for locking positioner 18 into one or more of the angular positions relative to platform member 12.

The angular positions of the positioner 18 relative to the platform member 12 may be determined by the clinician, the type of medical therapy delivered to patient or the orientation of the patient receiving the vibrational therapy. Positioner 18, as shown in FIG. 1 A, is positioned such that the angular relationship between the positioner 18 and the platform member 12 is substantially perpendicular and the platform member 12 is substantially horizontal.

In yet another embodiment of the present disclosure, pivoting mechanism may limit the angular movement of positioner 18, relative to the platform member 12, such that the angular condition of the positioner 18 in an open condition is optimal for a particular medical therapy. For example, for the treatment of DVT the pivoting mechanism may limit the angular movement of positioner 18, such that the maximum angular condition of the positioner 18 is substantially perpendicular to platform member 12.

Apparatus 10*b* may be repositioned or carried by grasping the handle 16 defined by the platform member 12.

Platform member 12 further includes at least one removable or fixed pad 24. Pad 24 supports the leg of a patient receiving vibrational treatment. The condition of pad 24 on platform member 12, relative to positioner 18, may be adjustable in order to provide proper support or positioning of the leg. Pad 24 may be placed against positioner 18 or spaced-apart from positioner 18.

Pad 24 may attach to platform member 12 to prevent movement during vibrational treatment. Various means of attachment may be used (i.e. velcro, snaps, buttons, clips, gel, adhesive or any combination thereof).

Apparatus 10*b* include at least one locating member 26 for locating the apparatus 10*b* during use. Locating member 26 may locate or position apparatus 10*b* relative to a structure, such as, for example, a bed, examination couch, patient stretch, patient trolley, patient recovery trolley, patient pallet, a chair, a wheelchair, an airline seat, a car seat, a bus seat, a sofa, a recliner, a scooter, etc.

Apparatus 10*b* may be positioned at the foot of a bed, or similar structure, with locating member 26 extending downward along the mattress at the foot of a bed thus preventing the apparatus 10*b* from moving toward the head of the bed during use. Similarly, locating member 26 may be positioned between the mattress and a bed's footboard thus securing the apparatus 10*b* to the foot of a bed.

Locating member 16 may position or secure apparatus 10*b* to a location approximate to a seat, such as a wheelchair, an airline seat, car seat, bus seat, recliner or scooter. For example, locating member 26 may be adapted to interface with a wheelchair footrest such that a patient sitting in a wheelchair may receive vibrational therapy. Locating member may be adapted to locate apparatus 10*b* in close proximity to patient's seat, such as a seat in an airplane, car or bus such that patient may receive vibrational therapy while traveling. Locating member 26 may be adapted to locate or position apparatus 10*b* relative to a sofa or recliner by extending into or under the sofa or recliner such that patient may receive vibrational therapy in the comfort of their home.

Figure 6:
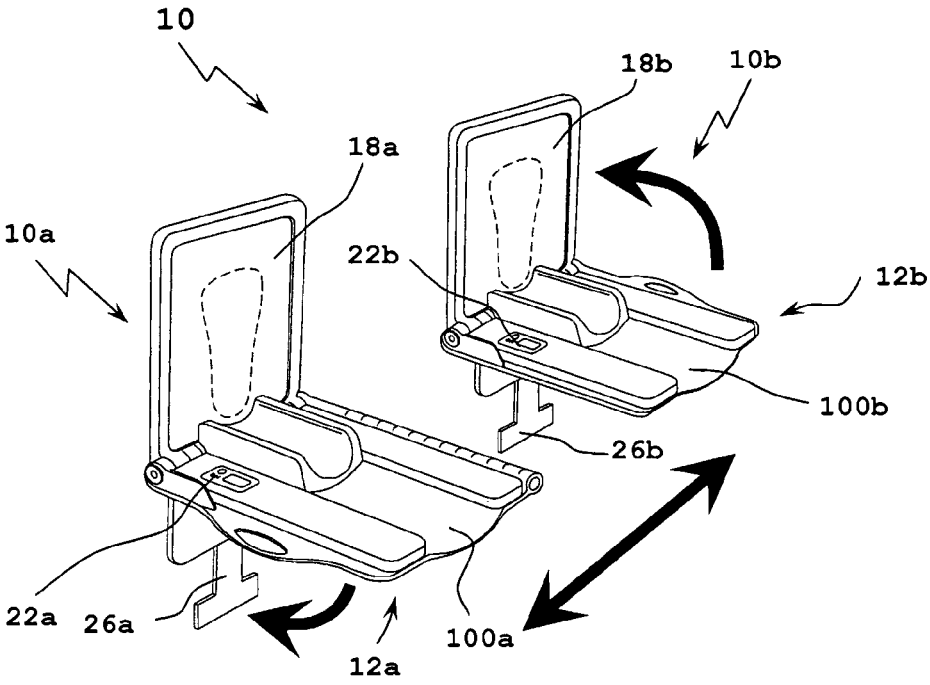
FIG. 6 is a perspective view illustrating a method for disconnecting the two vibrational therapy apparatuses in accordance with the present disclosure.
Figure 8:
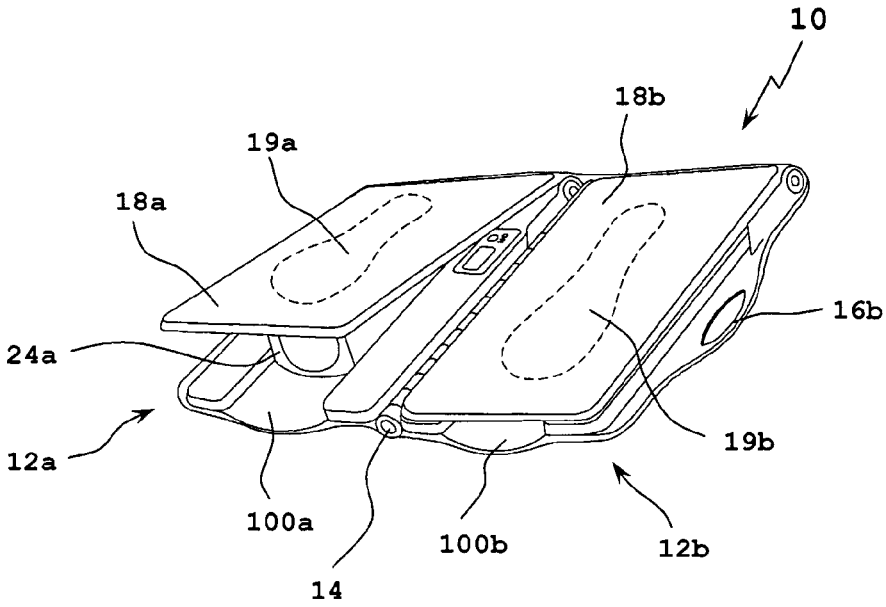
FIG. 8 is a perspective view illustrating two vibrational therapy apparatuses in a closed configuration, configured to deliver vibrational therapy to a patient standing on the apparatuses.

Locating member 26 may deploy from a first condition to a second condition. In the first condition, as illustrated in FIGS. 1 and 8, locating member 26 is substantially within or adjacent positioner 18 or platform member 12. In a second condition, as illustrated in FIGS. 1A and 6, at least a portion of locating member 26 is extended from positioner 18 or platform member 12. Locating member 26 may be pivotally attached to positioner 18 or platform member 12 wherein locating member 26 rotates about the pivot from the first condition to the second condition.

It is further envisioned to integrate the apparatus 10 with structure, such as to integrate the apparatus 10 with a bed, examination couch, patient stretch, patient trolley, patient recovery trolley, patient pallet, a chair, a wheelchair, an airline seat, a car seat, a bus seat, a sofa, a recliner, a scooter, etc.

Vibrational therapy apparatus 10*b* includes a low profile vibrating plate assembly 100 similar in structure and operation as the low profile vibrating plate system disclosed and described in U.S. Utility application Ser. No. 11/369,467 filed on Mar. 7, 2006 and in U.S. Provisional Application filed on Jul. 11, 2006.

Platform member 12 includes a low profile vibrating plate assembly 100 adapted for transmitting vibrational energy, as described in detail hereinbelow. Platform member 12 may further include a control panel 22 for controlling the operation of the vibrating plate assembly 100. Control panel 22 may include a user interface for programming the apparatus 10. Control panel 22 can be removed from platform member 12 and configured to operate as a remote control device in operative communication with vibrating plate assembly 100. Control panel 22, configured to operate as a remote control device, communicates via wired or wireless means with the apparatus 10*b*.

Apparatus 10*b* can also be provided with touch sensitive technology for sensing when the patient's foot is positioned to receive vibrational therapy. Vibrating plate assembly 100 is activated or actuated when it senses that the patient's foot is positioned to receive vibrational therapy, i.e. placed over the vibrating plate assembly 100 or in contact therewith or with pad 24.

Apparatus 10*b* is preferably powered by at least one battery for enabling the apparatus 10*b* to be mobile. Apparatus 10*b* may also include a power cord for plugging the apparatus 10*b* to an electrical outlet, when feasible, for charging or conserving battery power.

Figure 2:
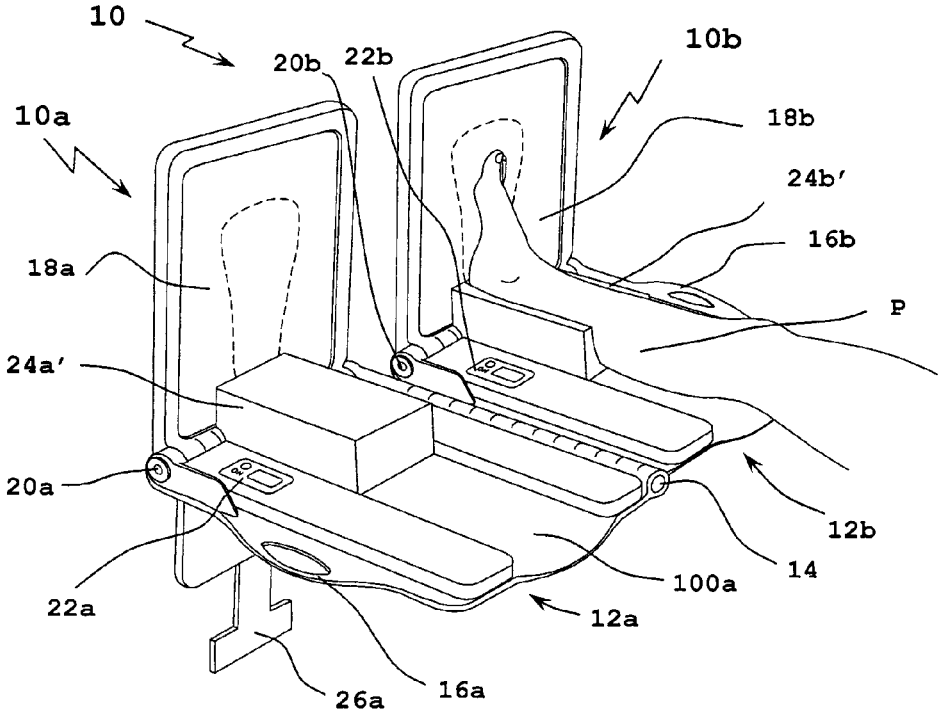
FIG. 2 is a perspective view of the two vibrational therapy apparatuses of FIG. 1, pivotally attached and in an open configuration, illustrating the internal components thereof in accordance with the present disclosure.

Referring now to FIG. 2, the vibrational therapy assembly 10 of FIG. 1 is illustrated with a first vibrational apparatus 10*a* and a second vibrational therapy apparatuses 10*b*. First vibrational apparatus 10*a* is operatively associated with second vibrational therapy apparatus 10*b*. Apparatuses 10*a*, 10*b* may be hingedly attached along one side with a connecting pin 14. First and second vibrational apparatuses 10*a*, 10*b* will disengage if connecting pin 14 is removed. Alternatively, the connecting means may include hinges, one or more ball and socket joints, one or more living hinges or other means of operatively associating two members as known in the art.

Each vibrational apparatus 10*a*, 10*b* include a platform member 12*a*, 12*b* and a positioner 18*a*, 18*b* operatively associated with each respective platform member 12*a*, 12*b*. Positioner 18*a*, 18*b* and the respective platform member 12*a*, 12*b* may be hingedly attached along one side with pivot pin 20*a*, 20*b*. Other means of forming a pivotal connection may be used, such as, for example, a plurality of hinges, one or more ball and socket joints, one or more living hinges or other means of operatively associating two members as known in the art.

Platform members 12*a*, 12*b* may define handles 16*a*, 16*b*, and include control pads 22*a*, 22*b* and at least one vibrating plate assembly 100*a*, 100*b*. Handles 16*a*, 16*b* are disposed at respective sides of platform members 12*a*, 12*b* which are advantageously configured to enable one to grasp and transport the apparatus 10 when in the portable configuration as illustrated in FIG. 1.

Locating members 26*a* (26*b* not shown) may be used to locate or position assembly 10 relative to a structure. Other configurations for the locating member 26*a* other than the configuration shown by the figures are envisioned. It is further envisioned to integrate the assembly 10 with structure, such as to integrate the assembly 10 with wheelchair, a bed, a chair, a scooter, patient pallet, examination couch, patient stretch, patient trolley, patient recovery trolley, etc.

Referring again to FIG. 1A, in use, pad 24 supports or positions a patient's leg for receiving vibrational treatment. Vibrational energy from vibrating plate assembly 100 is transferred to the patient's leg directly or through pad 24. Pad 24 may be formed of one or more materials with at least one material adapted to transfers energy from the vibrating plate assembly 100 to the patient. Pad 24 may be formed from various materials, such as, for example, plastic, bean-like material, sand, foam, memory foam or any combination thereof. Pads 24 may be supplied in a variety of pre-formed shape or a configuration wherein clinician or patient selects a pad 24 that best fits and supports patient's leg.

Pad 24 may be reusable or may be used one or more times before being removable and disposed. Reusable pad may be used for several treatments prior to disposal or may be designed to be used for the life of the apparatus 10. Disposable pad may be used for a single treatment or may be used for two or more treatments before being discarded.

In yet another embodiment of the present disclosure, pad 24 may be formed of a moldable material such as foam, memory foam, clay, plaster, paste, gel, etc. In FIG. 2, pad 24*a*' is a rectangular block in an unmolded or relaxed state. As further illustrated in FIG. 2, the material of pad 24*a*' conforms to the patient's leg when the leg is applied as shown by pad 24*b*'. Pads 24*a*', 24*b*' may maintain the shape after the leg is removed or pads 24*a*', 24*b*' may return to the unmolded or relaxed state.

Figure 3:
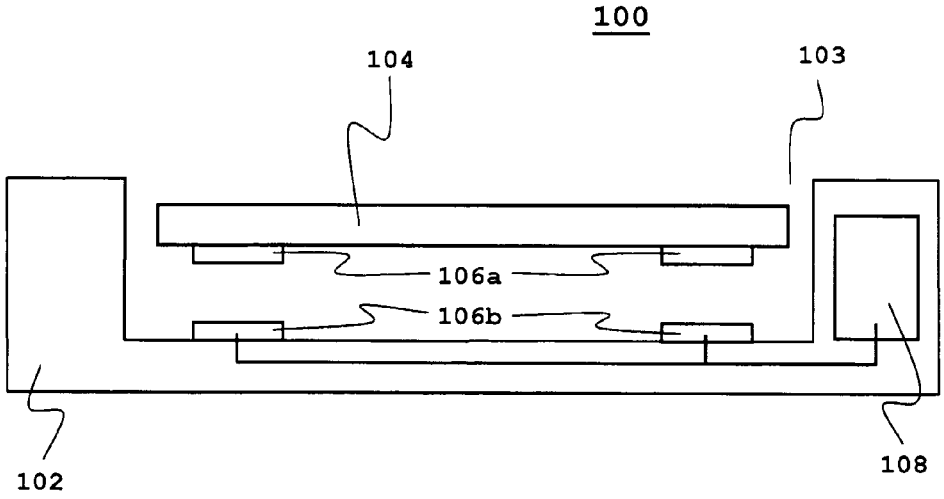
FIG. 3 is a schematic view of a vibrating plate incorporated in the apparatus in accordance with the present disclosure.

With reference to FIG. 3, low profile vibrating plate assembly 100 includes a low profile base 102 and a platform 104. Platform 104 rests within a cavity 103 formed on a top surface of base 102. A first set of magnets 106*a* is positioned on an underside portion of platform 104. Moreover, a second set of magnets 106*b* is positioned on a lower surface of cavity 103 of base 102. In a preferred embodiment, first set of magnets 106*a* is positioned in direct relation to second set of magnets, as illustrated in FIG. 3. Preferably, each paired magnet 106*a* and 106*b* are set with equivalent polarities facing each other, thus providing a repellant force therebetween consequently causing platform 104 to levitate above base 102. Vibrating plate assembly 100 further includes a processor 108 in operable communication with the second set of magnets 106*b*. Preferably, the second set of magnets 106*b* includes adjustable magnetic properties (e.g., polarity, magnetic field intensity) controlled by a processor 108. First and second set of magnets 106*a*, 106*b* may include, for example, static magnetic field generating devices, such as, for example, permanent Ferro-magnets, electromagnets, and coils. Other dynamic magnetic field generating devices is also envisioned.

By varying the field intensity and/or alternating the polarity of the base magnets 106*b* a vertical vibration of platform 104 may be induced. The vibrational frequency is determined by the rate of change of the magnetic properties, while the amplitude of the vibration is determined by the magnetic field intensity. Additionally, the magnetic field intensity may be increased or decreased as needed, depending on a patient's weight, to properly condition and vibrate platform 104. In accordance with the present disclosure, a patient or user is permitted to stimulate and enhance blood flow in the limbs, in a manner described in detail hereinbelow.

Figure 4:
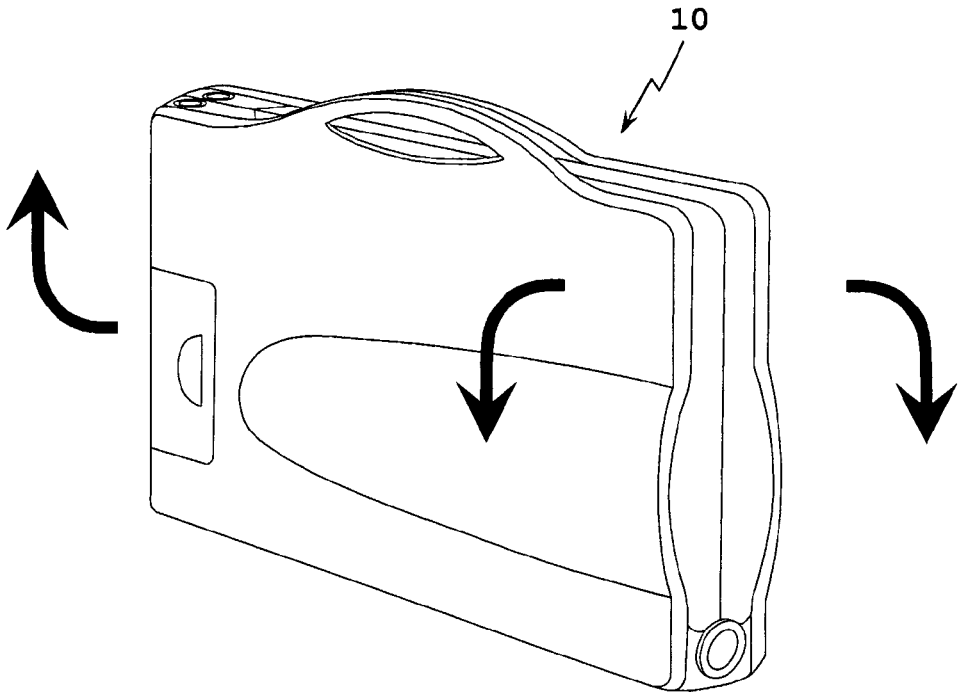
FIG. 4 is a perspective view of the vibrational therapy assembly of FIG. 1 illustrating a method for opening the assembly when in a portable configuration.
Figure 5:
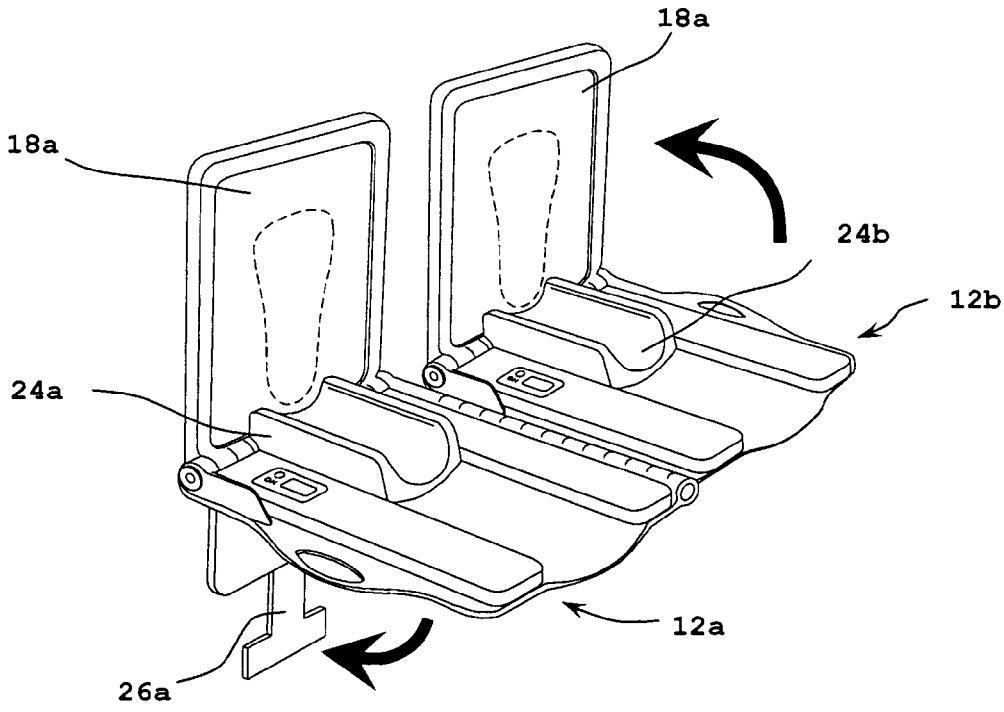
FIG. 5 is a perspective view illustrating a method for lifting the positioners of the vibrational therapy apparatus in accordance with the present disclosure.

When used, assembly 10 is first switched from a portable configuration, as illustrated in FIGS. 1 and 4, to a configuration in which the two apparatuses 10*a*, 10*b* are in a closed configuration, as illustrated in FIG. 8. As discussed hereinbelow, assembly 10 may deliver vibrational therapy to a patient standing on apparatuses 10*a*, 10*b* in a closed configuration. Positioners 18*a*, 18*b* may be pivoted from a closed configuration to the open configuration, as illustrated in FIG. 5 by the large curved arrow, by pivoting each positioners 18*a*, 18*b* away from the respective platform member 12*a*, 12*b*. Locating member 26*a* (26*b* not shown) pivots from a first condition to a second position, as indicated by the small arrow.

As illustrated in FIG. 6, apparatuses 10*a*, 10*b* of assembly 10 may also be separated from each other, as indicated by the double arrow. Assembly 10 may be separated into two apparatuses 10*a*, 10*b* in either a closed configuration or an open configuration by removing the connecting pin (not shown). Apparatuses 10*a*, 10*b* while in a closed configuration may be used be used to deliver therapeutic vibrational energy in a closed configuration or positioners 18*a*, 18*b* may be lifted upward, as shown by the large arrow, to expose vibrating plate assembly 100*a*, 100*b*. Alternatively, positioners 18*a*, 18*b* may pivot to an open configuration, as indicated by the large arrow, prior to separating the apparatuses 10*a*, 10*b*, as indicated by the double arrow. Locating member 26*a*, 26*b*, for positioning apparatuses 10*a*, 10*b* on a structure, are deployable from a first condition to a second condition, as indicated by the small arrow.

Figure 7:
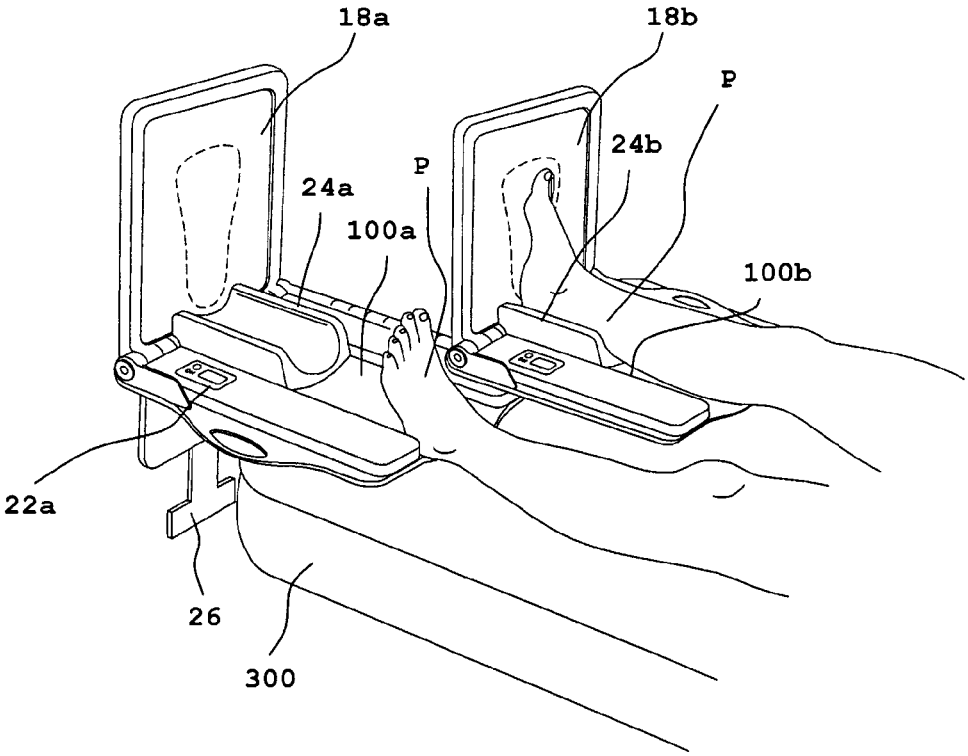
FIG. 7 is a perspective view illustrating the separated vibrational therapy apparatuses of FIG. 6 provided on a bed for enabling vibrational treatment for enhancing blood flow in the legs to treat or prevent the onset of DVT in accordance with the present disclosure.

As shown in FIG. 7, locating member 26*a* is used for positioning apparatus 10*a*, 10*b* on a structure, such as, for example, the edge of a mattress 300.

As illustrated in FIGS. 5-7, removable support pads 24*a* 24*b* are positioned on vibrating plate 100*a*, 100*b* prior to initiating vibrational treatment. It is envisioned that the assembly 10 may also be used without the support pads 24*a*, 24*b*.

As illustrated in FIGS. 6 and 7, apparatuses 10*a*, 10*b* may be detached, as shown by the double arrow in FIG. 6, for enabling treatment of one leg, if so desired, and for providing comfort to the patient. Each vibrating plate assembly 100*a* 100*b* has its own control panel 22*a*, 22*b* for enabling only one vibrating plate assembly 100*a*, 100*b* to be operated or actuated at a time, if so desired, for delivering vibrational energy.

FIG. 8 is a perspective view of the vibrational therapy assembly 10 including a first vibrational therapy apparatuses 10*a* and a second vibrational therapy apparatus 10*b* in a closed configuration. Positioners 18*a*, 18*b* are in juxtaposed relation to each respective platform member 12*a*, 12*b*. A human patient stands on assembly 12 with a foot positioned on each apparatus 10*a*, 10*b*. Proper foot placement may be indicated by a target, such as a footprint 19*a*, 19*b* or inset area (not shown) on positioner 18*a*, 18*b*. Pad 24*a* compresses due to the weight of the patient standing on positioner 18*a*, 18*b*, or pad 24*a* may be removed prior to positioning in a closed configuration. Positioners 18*a*, 18*b* contact at least a portion of platform members 12*a*, 12*b*, such that vibrational energy from vibrating plate assembly 100*a*, 100*b* is transferred to the respective positioner 18*a*, 18*b*. Handle 16*b* may be used to position or carry assembly 10.

In yet another embodiment of the present disclosure, positioner 18 includes at least one vibrational plate assembly, such as vibrating plate assembly 100, adapted to provide vibrational energy to patient tissue. In a closed configuration, vibrational plate assembly, of positioner, may deliver vibrational energy to patient tissue independent of the vibrational plate assembly 100 of platform member 12. For example, in the closed configuration, energy may be delivered from the vibrational plate assembly of positioner 18, and, in the open configuration, vibration energy may be delivered from the vibrational plate assembly 100 of platform member 12.

Alternatively, the first vibrational plate assembly 100 of platform member 12 and the vibrational plate assembly of positioner 18 may deliver vibrational energy simultaneously or may alternate delivery of vibrational energy.

The two or more vibrating plate assemblies may simultaneous deliver energy having the same frequency or may deliver vibrational energy having different frequencies.

Figure 9:
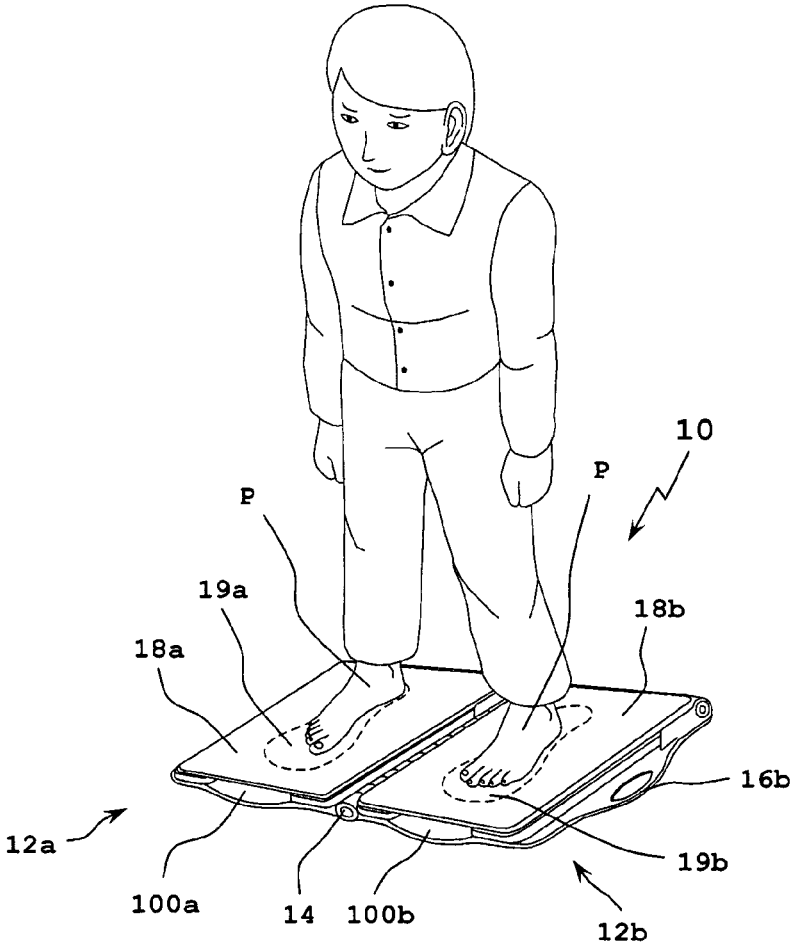
FIG. 9 is a perspective view illustrating the vibrational therapy apparatus of FIG. 8 providing vibrational energy to a patient.

Use of vibrational therapy assembly 10 is illustrated in FIG. 9. Footprints 19*a*, 19*b* on positioners 18*a*, 18*b* guide positioning of patient tissue P adjacent to or over at least a portion of platform member 12*a*, 12*b*, such as, for example, the positioning of a patient's foot P adjacent the vibrating plate assembly 100*a*, 100*b*. Vibrational energy, generated by each vibrating plate assembly 100*a*, 100*b*, is transferred through the respective positioner 18*a*, 18*b* to patient tissue P.

With reference to FIGS. 2, 7 and 9, vibrational therapy apparatus 10*a*, 10*b* and assembly 10 provide vibrational energy to patient tissue P with positioners 18*a*, 18*b* in various configurations. In FIGS. 2 and 7, positioners 18*a*, 18*b* are substantially perpendicular to platform member 12*a*, 12*b*. In FIG. 9, positioners 18*a*, 18*b* are in a juxtaposed relation to the platform member 12*a*, 12*b* and the various portions of the platform member 12*a*, 12*b*, such as, for example, the vibrating plate assembly 100*a*, 100*b*.

With reference to FIGS. 1, 2 and 8, after use, apparatus 10*a*, 10*b* is switched from an open configuration, as shown in FIG. 2, to a closed configuration, as shown in FIG. 8, where each positioner 18*a*, 18*b* is in juxtaposed relation to the respective platform members 12*a*, 12*b*. For ease of storage and for transporting assembly 110, apparatuses 10*a*, 10*b* in a closed configuration, as shown in FIG. 2, are folded together such that apparatuses 10*a*, 10*b* are in juxtaposed relation to each other forming a portable configuration, as shown in FIGS. 1 and 4.

In yet another embodiment of the present disclosure, positioner can act as a platform or base for the apparatus for enabling the vibrating plates 100 to be positioned vertically with respect to the positioner. In this configuration, a user is able to rest his legs within the removable pads 24 while seated.

With reference to FIG. 7, vibrational therapy apparatus 10*a*, 10*b* of the present disclosure are used to enhance blood flow in order to treat and prevent the onset of DVT. The amount of treatment time and the number of treatment sessions per day depends on whether the patient is treating DVT or is preventing the onset of DVT, the age of the patient, whether the patient is infirm, the weight of the patient (the heavier the patient, the longer the treatment time), etc.

It is envisioned to provide a processor, with memory capable of executing a set of instruction stored in the processor's memory, for enabling the apparatus 10*a*, 10*b* to be programmable via either by the user through the user interface on the control pad 22*a*, 22*b* or by a remote connection via communications circuitry provided within the apparatus 10*a*, 10*b* and in operative communication with the processor as described in a U.S. patent application filed on Jul. 17, 2006 titled "Dynamic Motion Therapy Apparatus Having a Treatment Feedback Indicator" , the entire contents of which are incorporated herein by reference. The processor can be programmed to sound an alarm when a treatment session should be started and to automatically shut-off the vibrating plate assembly 100*a*, 100*b* when the treatment time has lapsed. A memory within the processor can store patient treatment-related data and other information, such as name of patient, age, prescription medications being taken by patient, etc. The treatment related data can be transmitted to a remote monitoring station as described in a U.S. patent application filed on Jul. 17, 2006 titled "Dynamic Motion Therapy Apparatus Having a Treatment Feedback Indicator", While several embodiments of the disclosure have been shown in the drawings and/or discussed herein, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision other modifications within the scope and spirit of the claims appended hereto.

What is claimed is:

1. A vibrational therapy assembly comprising:

a first vibrational therapy apparatus comprising:

a first platform member including at least one low profile vibrating plate assembly for providing non-invasive vibrational energy; and a first positioner pivotably coupled to said first platform member, said first positioner disposed and structured for guiding patient tissue adjacent said at least one low profile vibrating plate assembly;

a second vibrational therapy apparatus comprising:

a second platform member including at least one low profile vibrating plate assembly for providing non-invasive vibrational energy;

a second positioner pivotably coupled to said second platform member, said second positioner disposed and structured for guiding patient tissue adjacent said at least one low profile vibrating plate assembly; and means for removably connecting said first and second vibrational therapy apparatus into a laterally joined operative orientation; and wherein each of said first and second vibrational therapy apparatus is capable of independent operation.

2. The assembly according to claim 1, wherein said means for removably connecting engages and disengages said first vibrational therapy apparatus from said second vibrational therapy apparatus.

3. The assembly according to claim 1, wherein said first vibrational therapy apparatus and said second vibrational therapy apparatus are actuating for providing vibrational energy in at least said first and second positioners.

4. The assembly according to claim 3, wherein in a first configuration said first and second platform members are substantially parallel with respect to each other and said first and second positioners are substantially perpendicular to respective ones of said first and second platform members.

5. The assembly according to claim 3, wherein in a second configuration said first and second platform members are substantially parallel with respect to each other and said first and said second positioners are respectively in covering relation to said first and said second platform members.

6. The assembly according to claim 1, further comprising:

a first locating member operatively associated with said first vibrational therapy apparatus; and a second locating member operatively associated with said second vibrational therapy apparatus.

7. The assembly according to claim 1, wherein said first and second positioners are in covering relation to said first and second platform members, and wherein said first vibrational therapy apparatus is in closed relation to said second vibrational therapy apparatus.

8. The assembly according to claim 7, wherein said first and second platform members define at least one handle.

9. A method for providing vibrational therapy, said method comprising:

providing a platform member having a low profile vibrating plate assembly, wherein said low profile vibrating plate assembly comprises a low profile base having a cavity formed in a top surface and a platform disposed within said cavity, wherein said platform is disposed in a spaced apart relation from said low profile base and is structured to vibrate upon actuation of said low profile vibrating plate assembly;

guiding patient tissue over said low profile vibrating plate assembly using a positioner pivotably coupled to said platform member and disposed in tissue guiding relation relative to said low profile vibrating plate;

actuating said low profile vibrating plate assembly to provide non-invasive vibrational energy; and adjusting said positioner relative to said platform member, such that the step of guiding patient tissue includes the step of having the patient stand on said positioner.

10. The method according to claim 9, wherein the step of guiding patient tissue includes the step of placing at least a portion of a patient's leg onto said platform member.

11. The method according to claim 9, further comprising the step of providing a pad on said at least one platform member.

12. The method according to claim 9, further comprising the step of transmitting treatment-related data to a remote monitoring station.

* * * * *